US006298210B1

(12) United States Patent
Bartscher

(10) Patent No.: US 6,298,210 B1
(45) Date of Patent: Oct. 2, 2001

(54) DEVICE FOR CREATING A UNIFORM TONER LAYER BY ELECTRICALLY CHARGING TONER PARTICLES

(75) Inventor: Gerhard Bartscher, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/250,867

(22) Filed: Feb. 16, 1999

(30) Foreign Application Priority Data

Feb. 14, 1998 (DE) ..... 198 06 170

(51) Int. Cl.[7] ..... G03G 15/08
(52) U.S. Cl. ..... 399/284
(58) Field of Search ..... 399/266, 281, 399/283, 284, 286, 289; 430/120

(56) References Cited

U.S. PATENT DOCUMENTS

| | | | | |
|---|---|---|---|---|
| 4,406,535 | * | 9/1983 | Sakamoto et al. | 399/274 |
| 4,450,220 | * | 5/1984 | Haneda et al. | 430/102 |
| 4,557,992 | | 12/1985 | Haneda et al. . | |
| 4,624,559 | | 11/1986 | Haneda et al. . | |
| 4,827,868 | * | 5/1989 | Tarumi et al. | 399/286 |
| 4,958,193 | * | 9/1990 | Nojima et al. | 399/286 |
| 4,990,958 | * | 2/1991 | Brewington et al. | 399/281 |
| 5,422,709 | | 6/1995 | Minagawa et al. . | |
| 5,499,084 | * | 3/1996 | Folkins et al. | 399/273 |

FOREIGN PATENT DOCUMENTS

| | | | |
|---|---|---|---|
| 31 43 397 C2 | | 5/1982 | (DE) . |
| 32 06 815 C2 | | 3/1983 | (DE) . |
| 34 25 933 A1 | | 1/1985 | (DE) . |
| 59-116668 | * | 7/1984 | (JP) . |
| 60-021072 | * | 2/1985 | (JP) . |
| 1-134378 | * | 5/1989 | (JP) . |
| 6-295121 | * | 10/1994 | (JP) . |
| 8-146732 | * | 6/1996 | (JP) . |

OTHER PUBLICATIONS

Japanese Patent Abstract No. 09034249 (Ichida Motoharu et al.), dated Feb. 7, 1997.
Japannese Patent Abstract No. 08142392 (Tanabe Masaichi), dated Jun. 4, 1996.
Japanese Patent Abstract No. 59–26759 (Shigenobu Oosawa), dated Feb. 13, 1984

* cited by examiner

*Primary Examiner*—Joan Pendegrass
(74) *Attorney, Agent, or Firm*—Herbert L. Lerner; Laurence A. Greenberg; Werner H. Stemer

(57) ABSTRACT

A device for developing an electrostatic latent image located on a movable image carrier, the developing device having a toner feeder for feeding toner particles from a toner reservoir and for electrically charging the particles, and a rotatably mounted developing roller having a surface for accepting the charged toner particles, includes a device spaced from the surface of the developing roller for generating an alternating electric field actable upon the toner particles; and a method for operating the developing device.

6 Claims, 2 Drawing Sheets

DEVICE FOR CREATING A UNIFORM TONER LAYER BY ELECTRICALLY CHARGING TONER PARTICLES

BACKGROUND OF THE INVENTION

Field of the Invention

The invention relates to a device and a method for developing an electrostatic latent image, more particularly, one that is located on a movable image carrier, the latent image being developed by the use of a single or one-component toner.

Electrographic printing with high quality and at high speed is possible according to the present state of the art by two-component toners or one-component toners. A type of development of a latent image by a one-component toner has become known heretofore from the published German Non-prosecuted Patent Application (DE-OS) 197 28 309.

A main difficulty with one-component systems is that a uniform layer of toner particles which are charged as uniformly as possible have to be generated on a developing roller, also termed an ink applicator roller. Some commercially used systems employ a rejuvenator roller formed of a material resembling foam plastic, for transporting toner particles from a toner reservoir to the developing roller. Friction produced in this process charges the toner particles electrically, due to which they adhere to the electrically conductive developing roller in a more-or-less thick layer. In order to homogenize this layer, use has been made of fixed doctor blades which scrape off excess toner from the developing roller. There are systems with a hard developing roller, for example, formed of aluminum or steel, and a rubber lip as a doctor blade, as well as systems also with a hard doctor blade and a developing roller made of rubber material.

The hereinaforementioned German Non-prosecuted Patent Application (DE-OS) 197 28 309 describes an electrostatic developing device for one-component toners which, by comparison with the prior art of one-component toners, permits a clearly higher speed. In this case, the toner particles are initially applied to the developing roller via a so-called rejuvenator roller formed of plastic material. The friction produced during this process charges the toner particles electrostatically, and they adhere via an electrostatic imaging force to the surface of the metallic developing roller. In a subsequent step, a doctor roller serves to reduce the thickness of the toner layer to a desired thickness and to homogenize it or make it uniform. Speeds of at least 50 cm/sec. are possible with such a developing device. It is regarded as disadvantageous, with regard to the developing stations known in the prior state of the art, that the toner layers cannot yet be made ready on the developing roller with adequate uniformity, for the purpose of high-quality printing. With regard to relatively high speeds, in particular, in the doctor blade processes known from the prior state of the art, slight stripes are formed during the respective doctor blade process, and become quite distractingly apparent in the developed image.

SUMMARY OF THE INVENTION

It is accordingly an object of the invention to provide a device and a method for developing an electrostatic latent image which ensure adequate homogenization or uniform distribution of the toner layer on the developing roller, in order thereby to produce high-quality printing.

With the foregoing and other objects in view, there is provided, in accordance with one aspect of the invention, a device for developing an electrostatic latent image located on a movable image carrier, the developing device including a toner feeder for feeding toner particles from a toner reservoir and for electrically charging the particles, and a rotatably mounted developing roller having a surface for accepting the charged toner particles, comprising a device spaced from the surface of the developing roller for generating an alternating electric field actable upon the toner particles.

In accordance with another feature of the invention, the field-generating device has an electrode structure.

In accordance with a further feature of the invention, the developing device includes a doctor roller having a surface separated from the surface of the developing roller by a gap wider than a mean diameter of the toner particles.

In accordance with an added feature of the invention, the field-generating device has a strip structure with radial structures.

In accordance with an additional feature of the invention, the field-generating device has a strip structure with axial electrodes.

In accordance with yet another feature of the invention, the electrode structure of the field-generating device has electrodes disposed in a mutual grid spacing corresponding to the spacing between the surface of the developing roller and the electrode structure.

In accordance with yet a further feature of the invention, the field-generating device has a strip structure disposed diagonally relative to a direction of movement thereof.

In accordance with yet an added feature of the invention, a continuous electrode is arranged downline of the field-generating device.

In accordance with yet an additional feature of the invention, the field-generating device is formed of wires.

In accordance with still another feature of the invention, the field-generating device has a conductor track structure.

In accordance with still a further feature of the invention, the surface of the developing roller has a defined surface roughness.

In accordance with still an added feature of the invention, the surface of the developing roller has a varied roughness.

In accordance with still an additional feature of the invention, the surface of the developing roller has a coating for promoting triboelectric interactions.

In accordance with another feature of the invention, the surface of the developing roller has a coating for promoting wear resistance of the surface.

In accordance with a further feature of the invention, the field-generating device is formed of metal.

In accordance with an added feature of the invention, the field-generating device is coated with an insulating material.

In accordance with an additional feature of the invention, a gap formed with varied size is located between the surface of the developing roller and the field-generating device.

In accordance with yet another feature of the invention, the gap is smaller at an input of the field-generating device than at an output of the field-generating device.

In accordance with an alternative feature of the invention, the gap is larger at an input of the field-generating device than at an output of the field-generating device.

In accordance with yet a further feature of the invention, an alternating voltage from an alternating voltage source is applicable to the field-generating device.

In accordance with yet an added feature of the invention, a temporary constant electric field is superimposable on an alternating electric field generated by the field-generating device.

In accordance with another aspect of the invention, there is provided a method for developing an electrostatic latent image produced on a movable image carrier by feeding electrically charged toner particles onto a surface of a developing roller and causing the particles to adhere thereat electrostatically, which comprises disposing a device for generating an electric field at a spaced distance from the surface of the developing roller, applying an alternating voltage to the field-generating device so as to generate a continuous alternating electric field actable on the toner particles for causing the toner particles on the surface of the developing roller to move and jump, respectively.

In accordance with a concomitant mode, the method of the invention includes superimposing a temporary constant electric field on the continuous alternating electric field.

The gist of the invention resides in installing an extended electrode structure (downline of the doctor blade), an alternating voltage being applied to the electrode structure. This measure generates a continuously alternating electric field, as a result of which the toner particles jump back and forth between the developing roller and the electrode structure, and thereby act upon the toner particles so that spatial inhomogeneities in the toner layer are homogenized in the process.

In a preferred embodiment, the developing device is constructed so that the electrode structure can act upon the developing roller over a greater distance. Assurance is provided by this measure that an adequate number of jumps are possible between the developing roller and the electrode structure. A greater distance is defined by the surface speed of the developing roller and by the frequency of the alternating voltage. If the developing roller, for example, has a surface speed of 50 cm/sec. and the frequency of the alternating voltage is 50 KHz, the toner particles jump one hundred times onto one centimeter.

In a preferred embodiment, it is assumed that approximately one hundred jumps lead to adequate homogenization. A correspondingly higher number of jumps leads to a more intense homogenization.

A spacing of between 50 to 100 $\mu$m has proved to be an ideal spacing between the developing roller and the electrode structure. It has further proved to be advantageous when a direct component is superimposed on the a-c voltage (having an amplitude of 400 volts), those voltages being referred to the electrode structure relative to the developing roller. For example, in the case of negatively-charged toner particles, a negative direct component (for example—200 volts) has the effect that no toner particles are deposited on the electrode structure at the output, the particles instead remaining completely on the developing roller.

There are various embodiments for the electrode structure.

There are also various embodiments for achieving the homogenization effect.

In one embodiment, the homogenization is performed by impacts. With each impingement of a toner particle on a surface, the toner particle rebounds from the surface. In this regard, the roughness of the surface and the irregular configuration of the toner particles can also produce a velocity component that is not perpendicular to the parallel surfaces of the developing roller and the electrode structure. However, the toner layer is homogenized by the statistical character of these impacts. It has proved to be advantageous for the electrode structure to be produced from one piece in the case of this type of distribution. The following embodiments are recommended.

A defined surface roughness, in order to promote or support the homogenization process advantageously.

In a further embodiment, regions of varied or different roughness are provided such as, for example, a higher roughness at the input, as a result of which relatively coarse inhomogeneities can advantageously be reduced. In order to achieve this goal, it is possible to provide a roughness gradient. In a further embodiment, provision is made for coating the surface in order advantageously to influence triboelectric interactions with the toner particles.

It has become known heretofore that toner particles on a developing roller do not all have the same charge. However, a high-quality developing process requires the particles to be charged as uniformly as possible. Furthermore, it is known (for example from the toner in a two-component system) that the charge of the toner particles generally increases with the number of contacts with a specific surface, and tends towards a final value. Consequently, the aforedescribed invention can be used not only for the spatial homogenization of the toner layer on the developing roller, but also for increasing and homogenizing the charge of the toner particles. The jumping between the electrode structure and the developing roller greatly increases the number of the contacts of the toner particles with the surfaces, thereby producing a more uniform charge.

It is, of course, possible for the materials of the toner, the surface of the developing roller and the surface of the electrode structure to be selected and/or coordinated with one another so as to promote this effect. A simple example would be using the same material for the surfaces of the electrode structure and the developing roller, the toner particles in contact with this material being charged negatively by triboelectricity.

The coating of the surface can, furthermore, advantageously increase wear resistance.

In a further construction, the electrode structure is formed of metal. It is advantageously possible, by this measure, for the applied voltage to have a full effect. Moreover, it is impossible for charges to collect on an electrically conductive surface and then otherwise accumulate and have an effect upon the field. In a further embodiment, the electrode structure is coated with an insulating material. It is possible by this measure advantageously to achieve a greater resistance to electric breakdown and to attain suitable triboelectric properties.

It is likewise possible to achieve an improved wear resistance by the use of insulating materials. Also, in an advantageous construction, provision is made for using conductive materials.

In a further advantageous embodiment, the gap between the developing roller and the electrode structure is configured with a varied size. Thus, for example, it is conceivable to provide a narrower gap at the input, for the advantageous purpose of initiating the jumping of the toner particles, and a larger gap is provided at the output in order to increase or further promote this effect.

Another possibility for homogenization in accordance with the invention is provided in an embodiment in which electrostatics are employed for the purpose of homogenization.

It is assumed in this case that virtually all of the toner particles have the same charge, so that they repel one another. Thus, if a relatively large quantity has accumulated at one point due to the doctor-blade process, the repelling forces will be larger in a first approximation, the more the particles have accumulated thereat. It is therefore readily apparent that such accumulations spontaneously reduce to form homogeneities when the conditions are appropriately prepared. As long as the toner particles are seated on the developing roller, they are virtually immovable due to the combination of electrostatic imaging forces and static friction. The alternating field detaches them from the surface, and the electrostatic relaxation process could then begin, in principle.

The electric field between the developing roller and the electrode structure constitutes a quasi-plate capacitor. The components parallel to the surface, i.e., the transverse components of the electric field, which are necessary for the homogenization process, have a strongly damping effect, in accordance with a plate capacitor.

This damping can therefore advantageously be reduced by an advantageous structuring of the electrode structure.

In a special construction, two embodiments are proposed to achieve amplification of the parallel field components. In one embodiment, the spacing between the surfaces of the developing roller and the electrode structure could be drastically increased (in the extreme case, the increase could be so great that the approximation of the effect of the plate capacitor principle no longer applies). In the further embodiment, provision is made to use one or more strips or grid electrode structures instead of a continuous electrode structure. This structuring advantageously breaks up the rigid structure of the plate capacitor and permits additional field components.

Provided among further embodiments for homogenization by electrostatic forces is an embodiment with radial and axial electrodes which serves the purpose of advantageously generating field components both in the axial and in the radial direction.

The strip electrodes should advantageously correspond to a grid spacing corresponding to the spacing between the surface of the developing roller and the electrode structure. These types of structures can be produced simply and cost effectively, for example, as flexible conductor tracks. Such flexible conductor tracks can be bonded in a simple manner to a carrier.

It is conceivable, in a further embodiment, to construct the strip structure mentioned above in such a way that the aforedescribed sequence of radial and axial electrodes is exchanged or switched.

In a further preferred embodiment, the strip electrode structure is provided only with strip electrodes diagonal to the direction of movement.

A particular embodiment results from the aforementioned strip electrodes being provided with an additional continuous electrode downline of the strip electrodes. This has the advantageous effect that a more effective superimposition permits a direct component with a consequence that the toner particles are held on the developing roller at the output.

In a further embodiment, tensioned or tautened wires are used instead of the flexible conductor tracks. The advantage thereof is that it is also then possible to use the space above the wires for the homogenization.

In a further embodiment, the strip electrode structure is introduced into a closed space. The toner particles or dust can thereby advantageously be prevented from escaping.

Provision is also made, within the scope of the invention, for the various features essential to the invention, such as gap parts having the different gap widths, respectively, and, in particular, the voltages present at the various electrodes, advantageously to be combined with one another.

Other features which are considered as characteristic for the invention are set forth in the appended claims.

Although the invention is illustrated and described herein as embodied in a device and a method for developing an electrostatic latent image, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
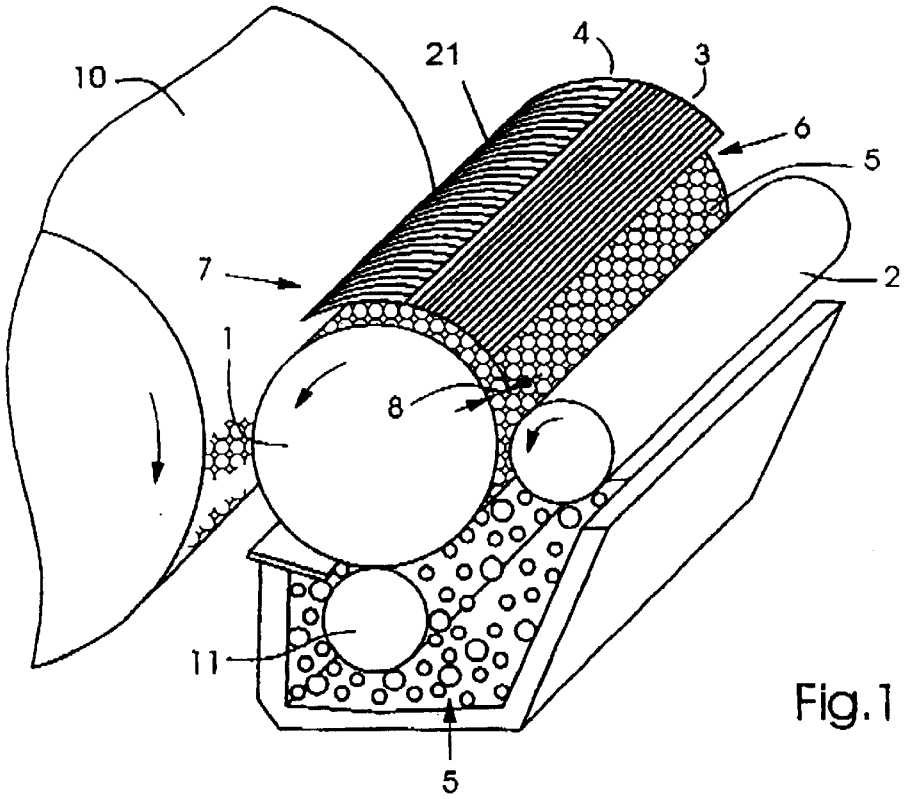
FIG. 1 is an end, side and top perspective view of an embodiment of a developing station according to the invention, having a vertical and radial electrode structure.

Referring now to the drawings and, first, particularly to FIG. 1, there is shown therein a developing station in which toner 5 is applied via a rejuvenator roller 11 onto the surface of a developing roller 1, and is transferred from the latter onto an image cylinder 10. In a particular embodiment of the invention, for a first homogenization, a doctor roller 2 is installed at a specific spaced distance from the surface of the developing roll 1. The doctor roller 2 produces a thin and relatively uniform toner layer on the developing roller 1.

This homogenization measure effected by the doctor roller 2 produces a first homogenization that is, however, not yet sufficient to produce high-quality printing results. This homogenization produced by the doctor roller 2 is followed by further rotation of the developing roller 1 which conveys the toner 5 into a region which is defined by the surface of the developing roller 1 and an electrode structure 3, 4 spaced therefrom. The electrode structure arrangement 3, 4 is suitably mounted so as to be removed an adjustable spaced distance 8 from the surface of the developing cylinder 1. Between the electrode structure 3, 4 and the surface of the developing cylinder 1, a space is formed having the spacing 8, limited at one side, i.e., above, in FIG. 1, by the electrode structure 3, 4, and at the opposite side, i.e., below, by the surface of the developing cylinder 1. The particles of the toner 5 migrate into this space. Applied to the electrode structure 3, 4 is an a-c voltage that generates an alternating field. In a preferred embodiment, a d-c voltage component can also be superimposed on the a-c voltage.

An alternating field acting upon the toner 5 is generated by applying the a-c voltage to the electrode structure 3, 4. Continuous alternation inside the alternating field stimulates the individual particles of the toner 5 to jump and hop, respectively. This measure homogenizes or evens out the toner 5 on the surface of the developing cylinder 1 even more markedly than does the homogenization or evening-out of the toner 5 previously performed by the doctor roller 2.

In a preferred embodiment, provision is made for the spacing 18 between the electrode structure 3, 4 and the surface of the developing cylinder 1 to have a different dimension at the output 7 of the electrode structure 3, 4 than the spacing 8 between the electrode structure 3, 4 and the surface of the developing cylinder 1 at the input 5 thereof. A continuous electrode 21 may be configured down-line of the electrode structure 3, 4.

Figure 2:
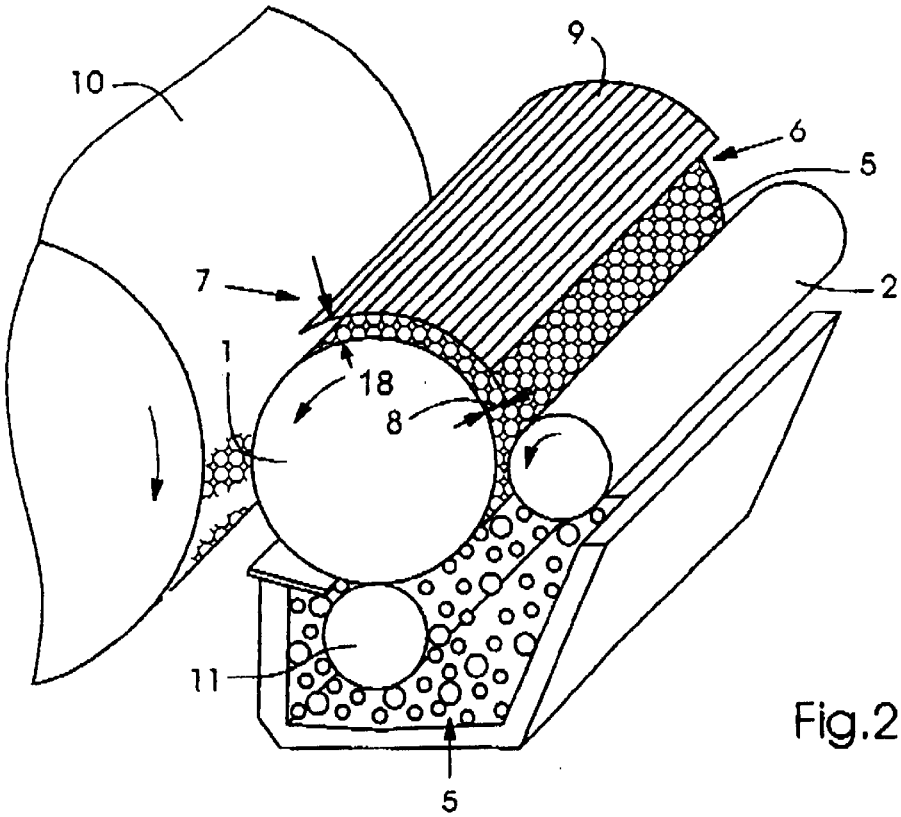
FIG. 2 is a view like that of FIG. 1 showing another embodiment of the developing station having a wire structure.

FIG. 2 differs from FIG. 1 in that, in a further embodiment, a different electrode structure 9, in wire form, is installed instead of the electrode structure 3,4. This wire form is achieved by introducing a non-illustrated holding device at a spaced distance from the surface of the developing cylinder 1, the wires 9 being subjected to tension or tautened between the surface of the developing cylinder 1 and the holding device.

This wire form also permits the use of the space, respectively, outside and above the wire electrode structure 9. By contrast, this is not possible with the embodiment according to FIG. 1, because, in a preferred embodiment, the electrode structure 3, 4 is produced therein in strip form by printed circuit board technology. By printed circuit board technology there is meant herein all methods heretofore known in the prior state of the art for producing printed circuit boards.

FIG. 1 shows an electrode structure arrangement 3, 4 which exhibits both radial and vertical electrodes. The sequence, whether initially the radial and then the vertical electrode structure are to be used, is freely selective. It is also conceivable that the radial electrode structure and the vertical electrode structure can be used when they are disposed above one another.

Figure 3:
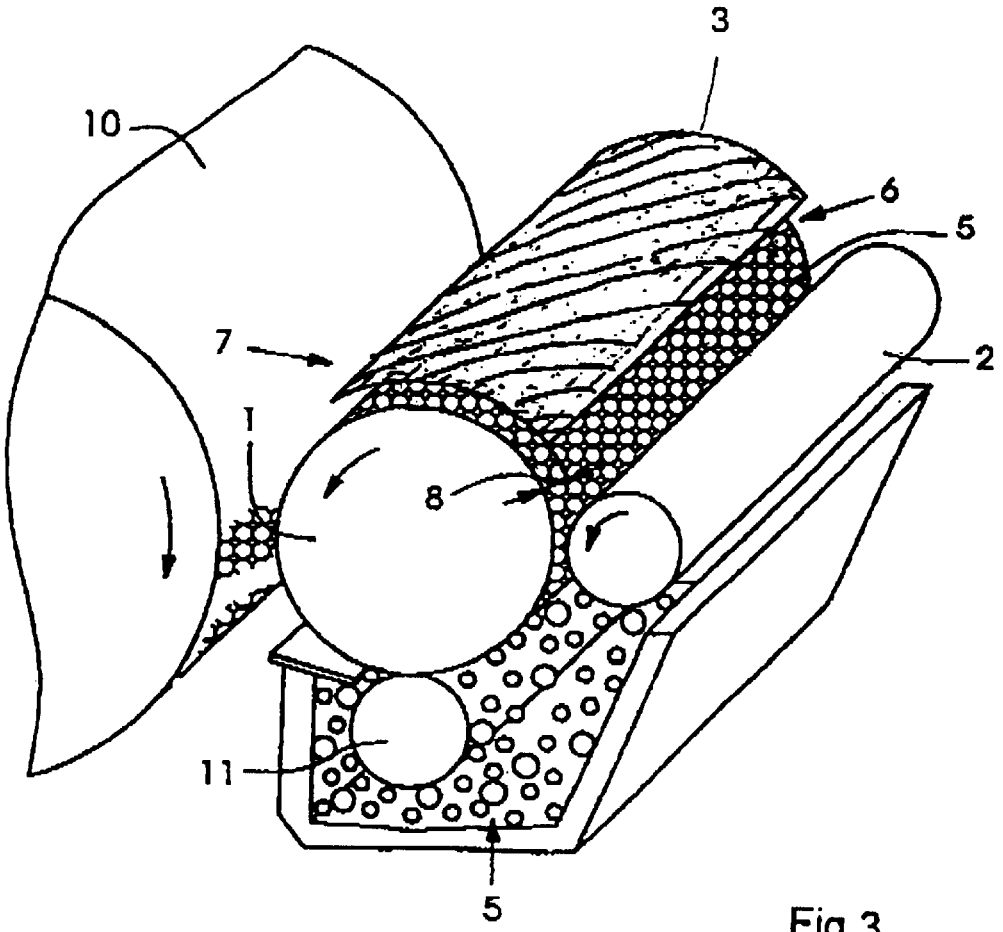
FIG. 3 is a view like that of FIG. 1 showing a diagonally disposed strip structure.

FIG. 3 shows a strip electrode structure 3 provided only with strip electrodes diagonal to the direction of movement.

I claim:

1. A device for developing an electrostatic latent image located on a movable image carrier, comprising:

a developing device including a toner feeder for feeding toner particles from a toner reservoir and for electrically charging the particles;

a rotatably mounted developing roller having a surface for accepting the charged toner particles; and a field generating device spaced from the surface of the developing roller for generating an alternating electric field actable upon the toner particles, said field-generating device having a strip structure with radial structures.

2. A device for developing an electrostatic latent image located on a movable image carrier, comprising:

a developing device including a toner feeder for feeding toner particles from a toner reservoir and for electrically charging the particles;

a rotatable mounted developing roller having a surface for accepting the charged toner particles, the surface of the developing roller having a roughness for creating a homogenous toner particle layer; and a field generating device spaced from the surface of the developing roller for generating an alternating electric field actable upon the toner particles;

said field-generating device having an electrode structure;

said electrode structure of said field-generating device having electrodes disposed in a mutual grid spacing corresponding to the spacing between the surface of the developing roller and said electrode structure.

3. A device for developing an electrostatic latent image located on a movable image carrier, comprising:

a developing device including a toner feeder for feeding toner particles from a toner reservoir and for electrically charging the particles;

a rotatably mounted developing roller having a surface for accepting the charred toner particles; and a field generating device spaced from the surface of the developing roller for generating an alternating electric field actable upon the toner particles, said field-generating device having a strip structure disposed diagonally relative to a direction of movement thereof.

4. A device for developing an electrostatic latent image located on a movable image carrier, comprising:

a developing device including a toner feeder for feeding toner particles from a toner reservoir and for electrically charging the particles;

a rotatably mounted developing roller having a surface for accepting the charged toner particles;

a field generating device spaced from the surface of the developing roller for generating an alternating electric field actable upon the toner particles, said field generating device having an electrode structure; and a continuous electrode arranged downline of said field-generating device.

5. A device for developing an electrostatic latent image located on a movable image carrier, comprising:

a developing device including a toner feeder for feeding toner particles from a toner reservoir and for electrically charging the particles;

a rotatable mounted developing roller having a surface for accepting the charged toner Particles, the surface of the developing roller having a roughness for creating a homogenous toner particle layer; and a field generating device spaced from the surface of the developing roller for generating an alternating electric field actable upon the toner particles;

said field-generating device having a conductor track structure.

6. A device for developing an electrostatic latent image located on a movable image carrier, comprising:

a developing device including a toner feeder for feeding toner particles from a toner reservoir and for electrically charging the particles;

a rotatably mounted developing roller having a surface for accepting the charred toner particles;

a field generating device spaced from the surface of the developing roller for generating an alternating electric field actable upon the toner particles; and a gap formed with varied size is located between the surface developing roller and said field-generating device;

wherein said gap is smaller at an input of said field-generating device than at an output of said field-generating device.

* * * * *